US006149330A

United States Patent [19]

Chuang

[11] Patent Number: 6,149,330

[45] Date of Patent: Nov. 21, 2000

[54] BUILDING BLOCKS TYPE WRITING INSTRUMENT

[75] Inventor: Cheng-hua Chuang, Taipei, Taiwan

[73] Assignee: Pioneer Industrial Corporation, Taipei, Taiwan

[21] Appl. No.: 09/280,537

[22] Filed: Mar. 30, 1999

[51] Int. Cl.[7] ..... B43K 27/04

[52] U.S. Cl. ..... 401/57; 401/34; 401/35; 401/88

[58] Field of Search ..... 401/34, 35, 57, 401/88, 52, 195

[56] References Cited

U.S. PATENT DOCUMENTS

| | | | |
|---|---|---|---|
| D. 346,619 | 5/1994 | Ho | D19/36 |
| 2,493,892 | 1/1950 | McPhee | 401/97 |
| 3,961,852 | 6/1976 | Parry | 401/195 |
| 4,610,556 | 9/1986 | Tsai | 401/18 |
| 5,044,804 | 9/1991 | Chuang | 401/34 |
| 5,791,798 | 8/1998 | Yu | 401/57 |
| 5,957,601 | 9/1999 | Weiss | 401/18 |

*Primary Examiner*—Henry J. Recla
*Assistant Examiner*—Peter deVore
*Attorney, Agent, or Firm*—Burns, Doane, Swecker & Mathis, L.L.P.

[57] ABSTRACT

A building blocks type writing instrument having a plurality of writing units, each of which is provided with a pencil lead at its front end, and at least one coupling unit engaged insertedly axially with each other in series. The writing units is formed having the front end provided with a tubular projection for insertion of pencil lead and the rear end with an insertion hole for insertion and engagement of the tubular projection at the front end, and on the outer circumferential surface at least one engaging projection at least one coupling groove corresponding to the engaging projection for engagement side by side transversely of another writing unit by corresponding engaging groove and projection. The coupling unit has a tubular body with front end and the lower portion provided on the two back to back lateral sides each cross shape coupling unit for cross engagement of the writing units. As one with a tubular projection corresponding to that of the writing unit. On the rear end there is an insertion hole corresponding to that of the writing unit. Further on the two lateral sides where a tubular projection is absent are located with engaging projection and or coupling grooves corresponding to the those of the writing unit. The tubular body and the three tubular projections, in total, form a T-shaped coupling unit.

15 Claims, 10 Drawing Sheets

BUILDING BLOCKS TYPE WRITING INSTRUMENT

FIELD OF THE INVENTION

The present invention relates to a building blocks type writing instrument and, more particularly, to a construction comprising a plurality of writing components having on the front end pencil lead and at least one coupling unit for inserting and engaging one another serially in order to form a writing instrument for purpose of both writing and playing as actual building blocks as well.

BACKGROUND OF THE INVENTION

In the past, the applicant used to develop a kind of "non-sharpening pencil" with insert circulating type pencil lead as showed in FIG. 10, consisting of a hollow tubular body A and a plurality of writing units C having each a pencil lead B installed at its front end and accommodated and held in a head to tail insertion state in the tubular body A. At the time while the pencil lead B installed at the front-most end of writing unit C worn out during writing, the writing unit C positioned at the front end of the tubular body A can be taken off and again inserted into the tubular body A from its rear end in order to extrude the second writing unit C located at the front end of the tubular body A so as to keep on writing continuously. In this way, it is changeable in turn until the last writing unit C worn out finally. Although it has been very good in writing without using any little knife or pencil sharpener, but still there are disadvantages on this kind of writing instrument, such as (1) the whole pencil will be useless if any one of the writing units is lost by accident, (2) it did not meet the requirement of the environmental protection as the whole pencil must be thrown away when every writing units are worn out, (3) the reusable component is the tubular body only and the writing units still need to be thrown away after replaced with new writing units, and it was not comply with the concept of environmental protection as well.

Again referring to FIG. 11, a "non-sharpening pencil" comprises a plurality of socket units E insertible in a head to tail manner forming in series a tubular body D, and a long pencil lead F passing through every socket unit E. The first socket unit E positioned at the front end is detached while the pencil lead F protruding out from the front end of the tubular body is worn out. There is a new pencil lead F extruded out of the socket unit for writing accordingly and the detached socket unit E can be inserted into the receiving hole locating at the rear end of the rear-most socket unit E and thus still maintain the same length of the original tubular body B. Although it was very helpful on reusable purpose of the socket unit, but in case the receiving hole for pencil lead was too loose then it would result in withdrawal of the pencil lead and causing it unable to write at all. When it was too tight then the pencil lead would be broken easily while inserting/coupling the socket units. In addition, the reason why it was not mass-produced and sold in the market was because the used socket units could not have another usage at all.

To solve the above problems in the known writing instruments the inventor had submitted a new writing instrument with detachable function in the art of U.S. Pat. No. 5,044,804 therein not only the serial coupled writing units themselves had no need to be held by an exterior tube any more but also instead that every writing unit could be used as a mini writing instrument individually and also be coupled all together and thus became a long writing instrument as well.

Moreover, the used writing units with worn out pencil leads were collectable and then acting as educational building blocks were allowed to be made up into three dimensional toys as one pleases. It was therefore very popular in the markets. However, this kind of writing instrument had little changes in combination and the writing units could only be engaged in same/reverse direction parallel to each other or coupled together one another.

In the light of above facts, the inventor intended to extend the variety of combination and also the additional functions in order to promote the valuation of the relative product and thus came up with an improved building blocks type writing instrument of the present invention.

SUMMARY OF THE INVENTION

Accordingly, an object of the present invention is to provide a building blocks type writing instrument, comprising a plurality of writing units having pencil lead at the front end thereof and at least one coupling unit engaged insertedly with each other to form structure that can be used as an instrument in writing and can also be used in play as building blocks and that in combination can be formed into a building blocks type writing instrument with further changes.

A further object of the present invention is to provide a building blocks type writing instrument in which the coupling units is formed in a T-shaped connector to provide engagement of the writing units serially mutually perpendicular to each other in three directions thereby improving more changes in combination.

A further object of the present invention is to provide a building blocks type writing instrument in which the coupling unit is formed in a cross-shaped connector to provide for the writing units to be engaged serially mutually in a cross shape.

An additional object of the present invention is to provide a building blocks type writing instrument in which the coupling unit is formed in a container with attached lid, that can accommodate small article such as eraser, a paper clip, and of which the front and rear ends are provided each with at least one projection for the writing units to be engaged insertedly with each other in an opposite direction.

Another object of the present invention is to provide a building blocks type writing instrument that can be used as a general writing implement and can also be used as a parallel line drawing pen to draw parallel lines simultaneously,

BRIEF DESCRIPTION OF THE DRAWINGS

Embodiments of the invention will now be described by way of example with reference to the accompanying drawings, according to which.

DETAILED DESCRIPTION OF PREFERRED EMBODIMENTS

Figure 1:
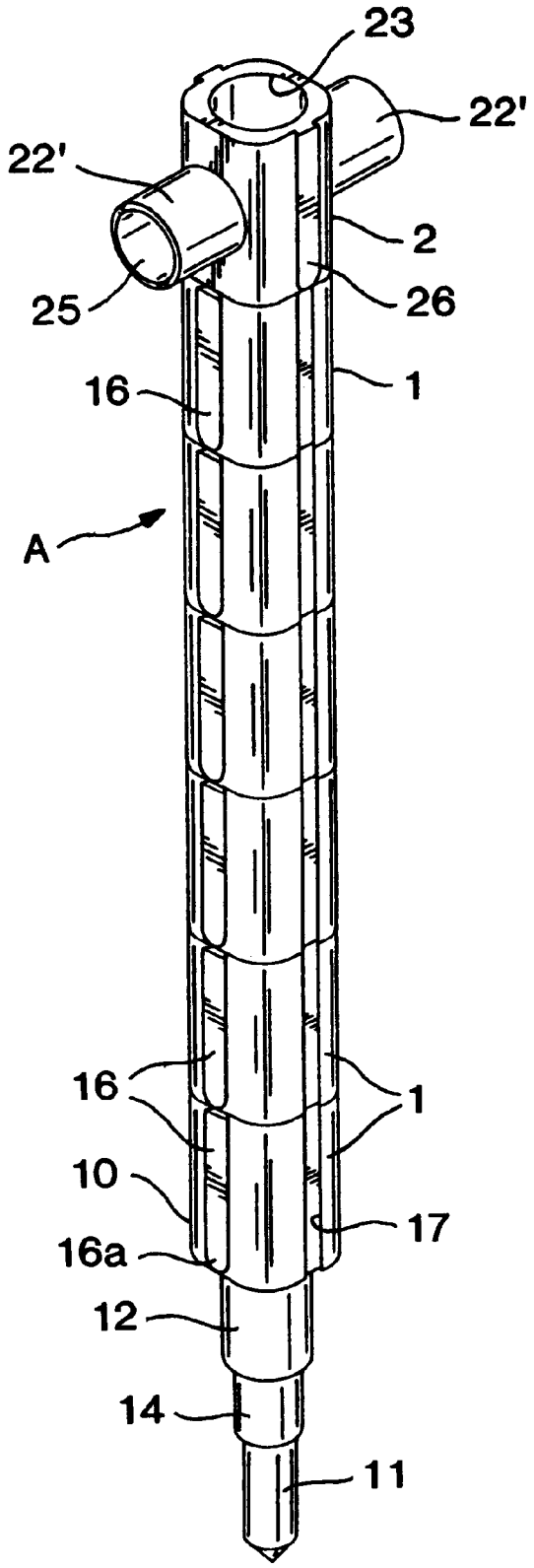
FIG. 1 is a perspective view of the first embodiment of a writing instrument according to the invention.
Figure 2:
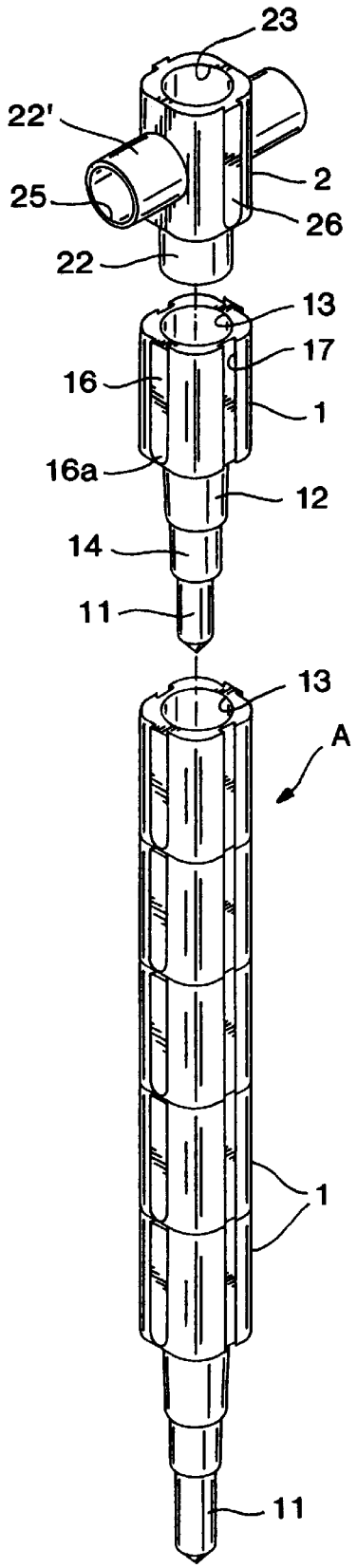
FIG. 2 is a partially exploded perspective view of a writing instrument according to the invention.
Figure 3:
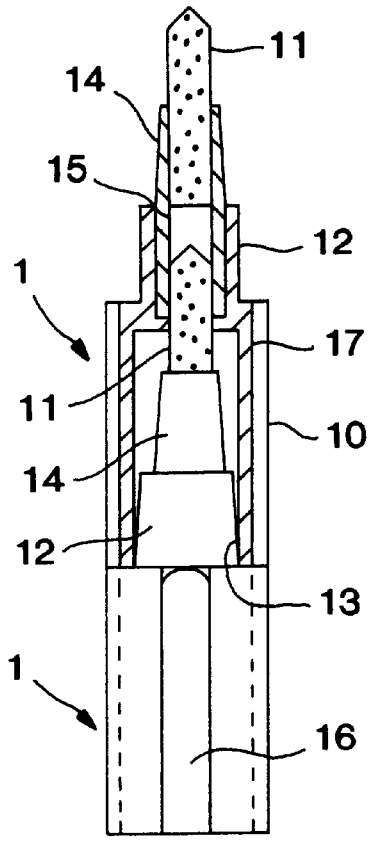
FIG. 3 is a partially longitudinally sectional view illustrating writing units of the instrument in the engaged inserting condition.

In the first place, with reference to FIGS. 1–3, according to the first embodiment of the invention, a building blocks type writing instrument A comprises a plurality of writing units 1 having pencil lead 11 positioned at the front end of each unit and at least one coupling unit 2 which is detachably interconnected in longitudinal direction to one another.

Figure 12A:
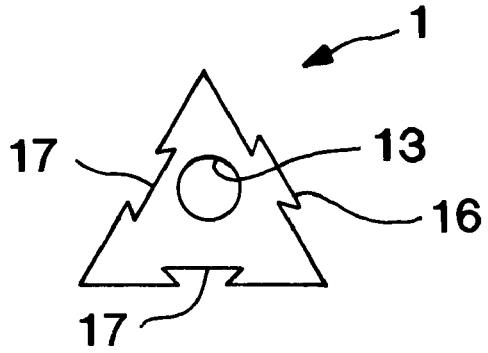
FIGS. 12A–12C are schematic top views of triangular, circular, and oval writing units, respectively.
Figure 12B:
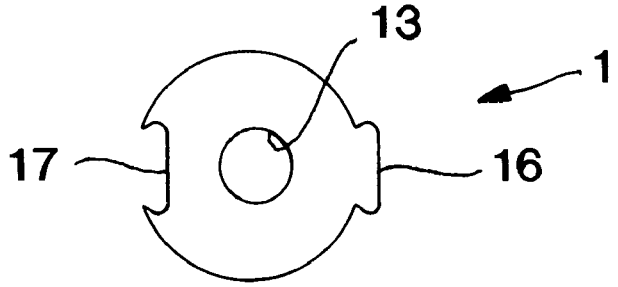
Figure 12C:
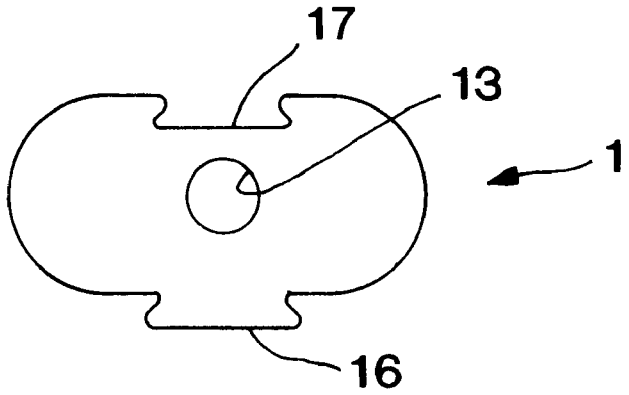

The writing unit 1 consists of a socket block 10 having a little tubular projection 12 at its front end and wherein another little tubular projection 12 from another writing unit 1 is inserted into the rear hole 13 of the socket block 10, thereby a pencil lead 11 is inserted into the receiving hole 15 positioned at the rear end on the tubular projection 12 from another socket block 10 with its pencil lead holding tube 14. At appropriate location on the outer circumference for the socket block 10 there is at least one engaging projection 16 extending axially together with its coupling groove 17, and by the way of the arrangement between the engaging projection 16 and coupling groove 17 thus the writing units are allowable to be engaged with and detached from each other horizontally and freely as well. According to the embodiment of the invention, the socket block 10 in section has a square shape construction with four rounded angles therein one pair of engaging projections 16 and coupling grooves 17 are positioned in the side opposite to each other on the outer circumference of the socket block 10 respectively, and also for an easier engagement, one end of the engaging projection 16 is formed into a circular shape construction 16*a*. Apparently, the section of the socket block 10 may also be formed into a triangle, square, circular, oval or even polygonal shape. FIGS. 12A–12C show triangular, circular, and oval-shaped writing units 1, respectively. If with a square shape construction for socket block 10, instead of arranging both the engaging projection 16 and coupling groove 17 to locate at the side opposite to each other as above it will be acceptable to set them up just side by side or to be even just installed of one engaging projection 16 with one coupling groove 17. And with a triangle construction for socket block 10, the engaging projection 16 may be located on one side and the coupling grooves 17 be positioned on the two other sides, or vice versa. In addition, it is also acceptable to have the both ends on the engaging projection 16 formed into two circular shape construction 16*a*.

By using the pencil lead holding tube 14 it makes the possibility for the pencil lead 11 to be detachably inserted in the receiving hole 15 on the projection 12, so it is possible to integrate both the pencil lead holding tube 14 and the projection 12 into one piece construction. And the pencil lead 11 may either be a regular pencil lead, color pencil lead, refill for ball point pen or even tubular shape eraser instead.

Figure 4:
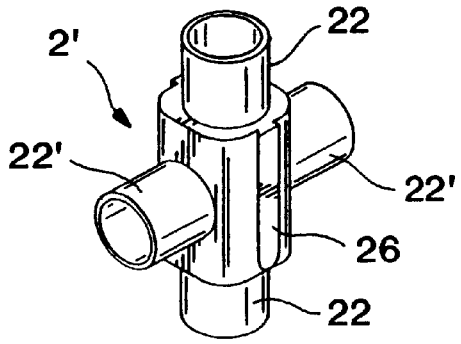
FIG. 4 is a perspective view of another embodiment of a coupling component according to the invention.

Basically, the shape for coupling unit 2 is same as the socket block 10 and comprises projection 12, rear holes 13, 15, and tubular projection 22 of the engaging projection 16, holes 23, 25 and a pair of coupling projection 26. Instead of equipping with grooves, on the two sides there are two similar outwardly protruding tubular projections 22' perpendicular to the tubular projection 22 thus forming a T shaped coupling unit 2. Hence in this way the writing unit 1 can be engaged in the tubular projections 22, 22', and hole 23 and extend in both transverse and longitudinal directions. With reference to FIG. 4, it shows a variant of construction for the coupling unit wherein, the coupling unit 2' is formed in a cross shape having two longitudinal projections 22 and two lateral projections 22' but the other portions are basically same as the coupling unit 2. The coupling projection 26 can be replaced by two grooves instead.

Figure 5:
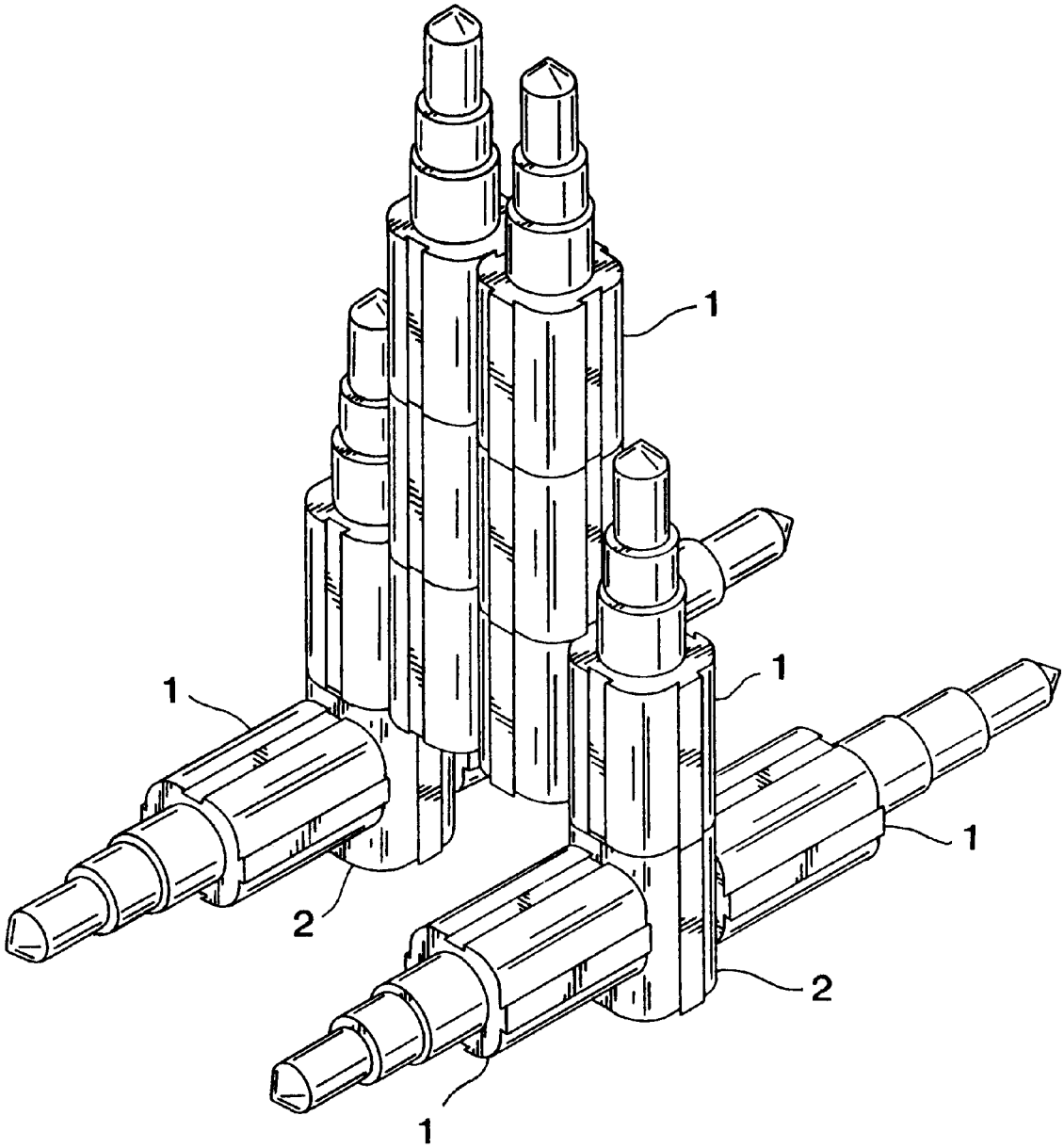
FIGS. 5–7 are perspective views showing examplars using individual units to form in combination into various kinds of 3-dimentional toys according to the invention.
Figure 6:
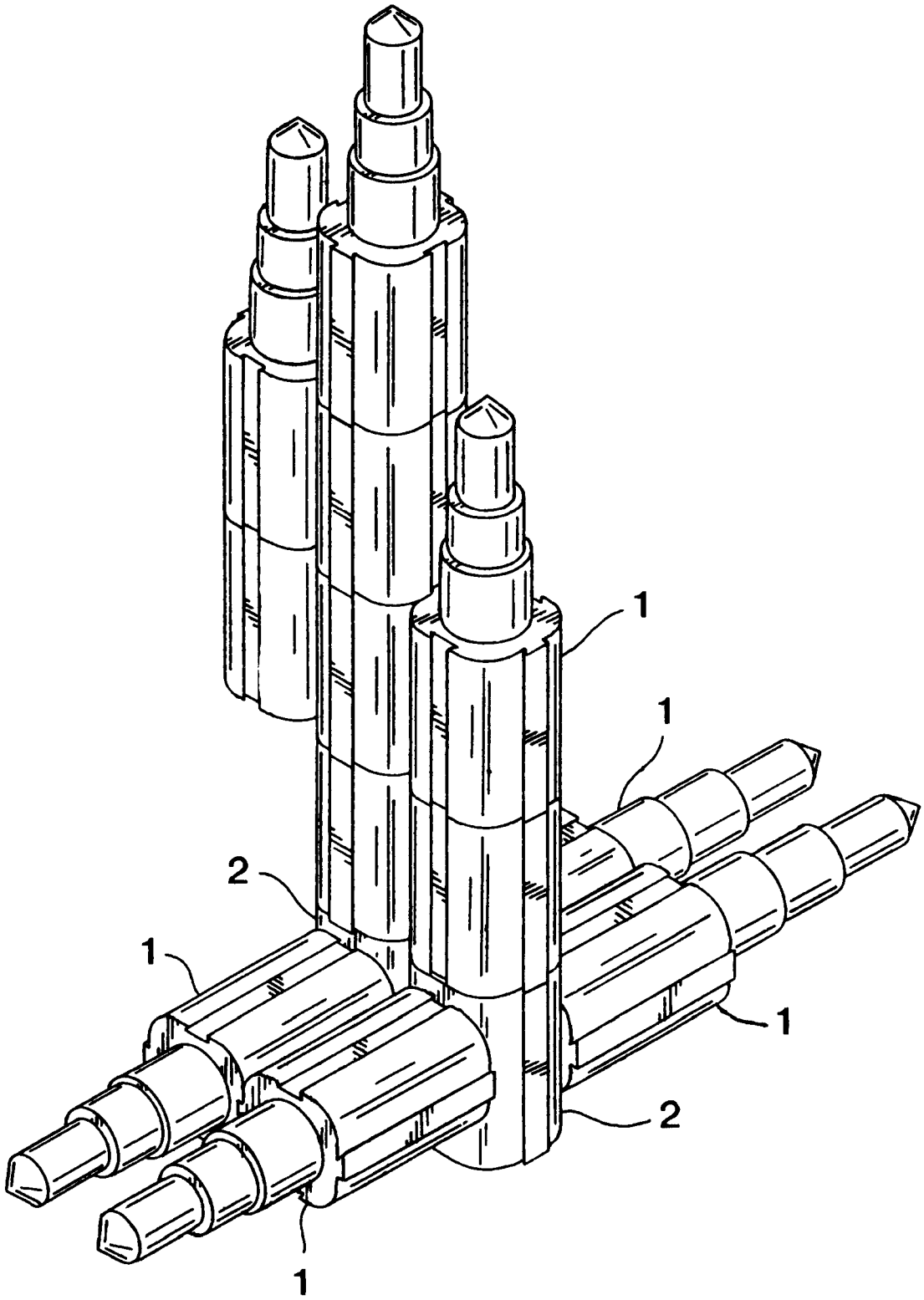
Figure 7:
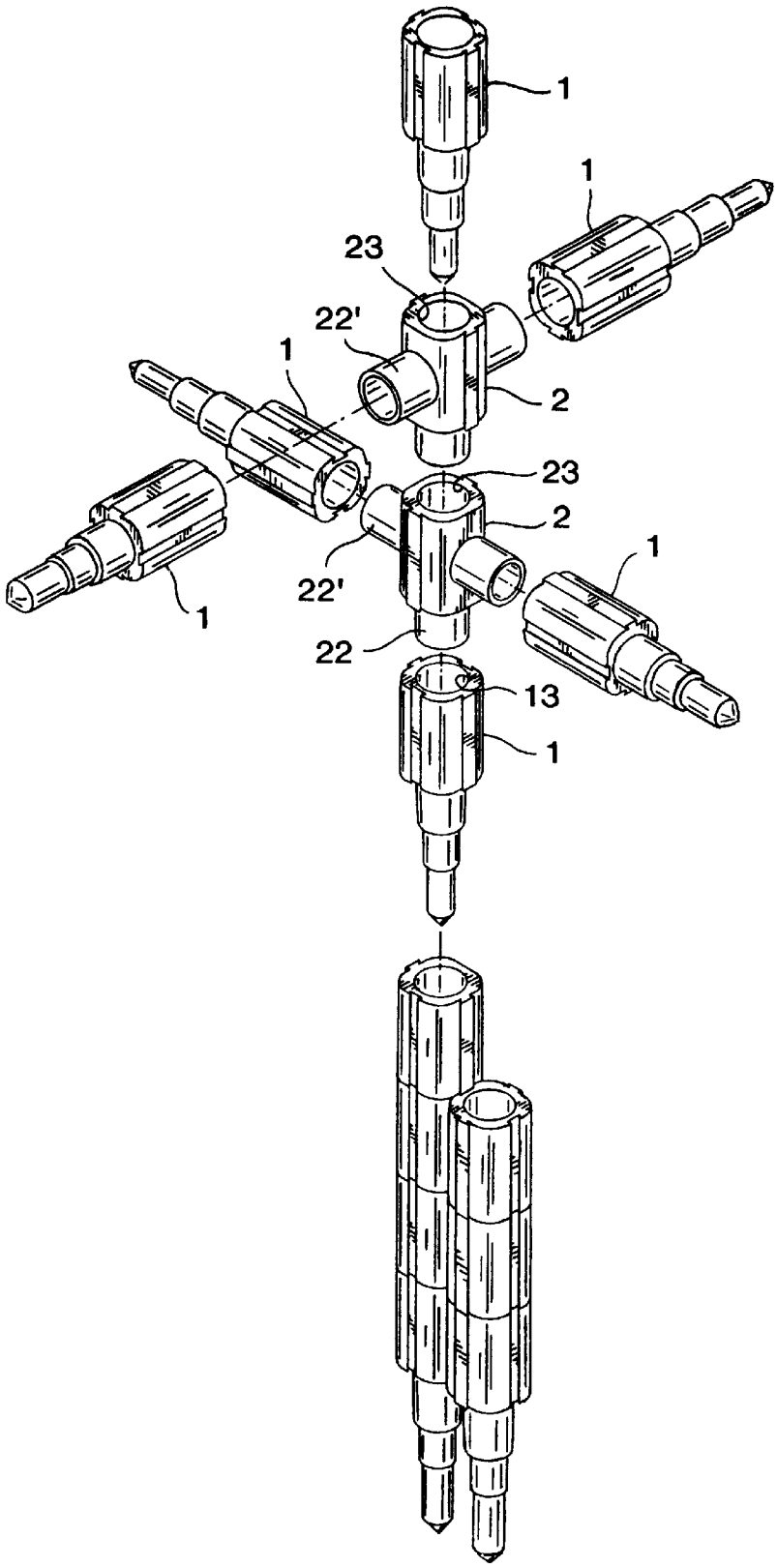

According to the FIGS. 5 through 7, there are shown a few examplars of the invention illustrating the usage of the units 1 and 2 to make up all kinds of creative building blocks, and the construction consists of two coupling units 2 and a number of writing units 1, the more quantity of the units 1,2 the more complicated combination will result accordingly.

Figure 8:
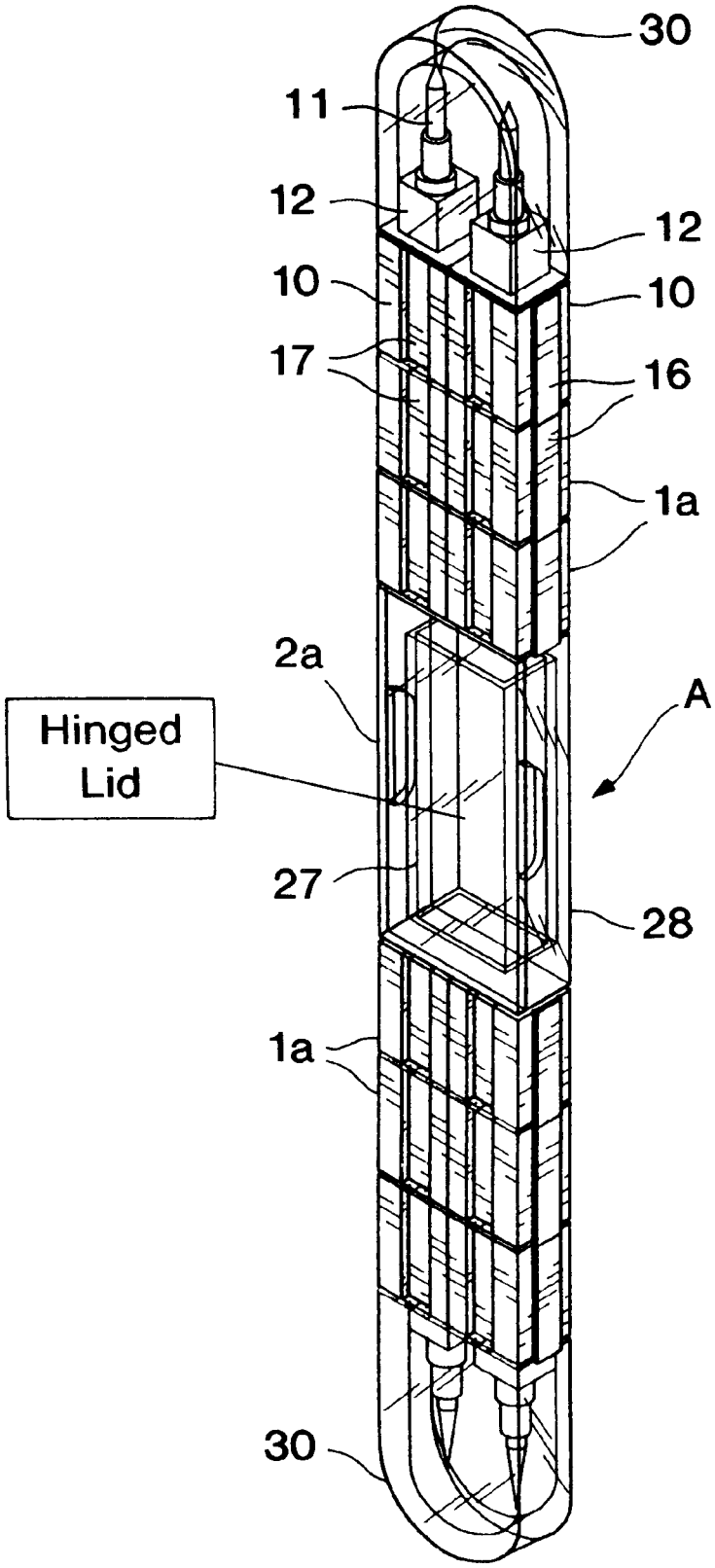
FIG. 8 is a perspective view of a second embodiment of a writing instrument according to the invention.
Figure 9:
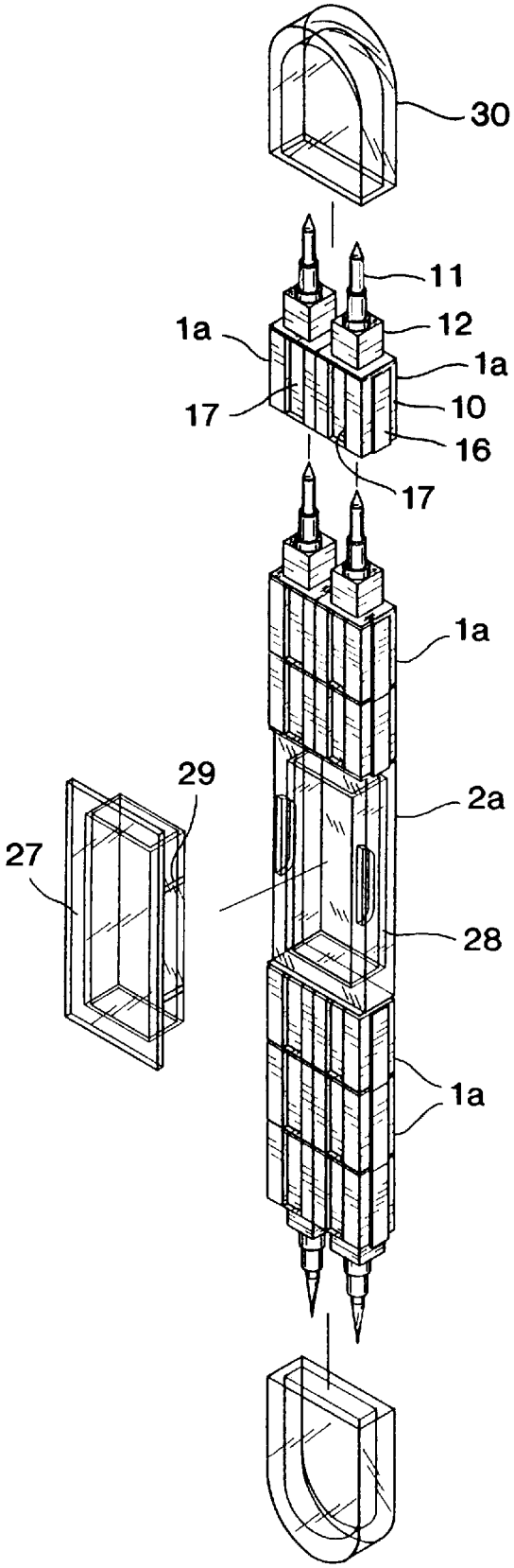
FIG. 9 is a partially exploded perspective view of the writing instrument shown in FIG. 8.
Figure 10:
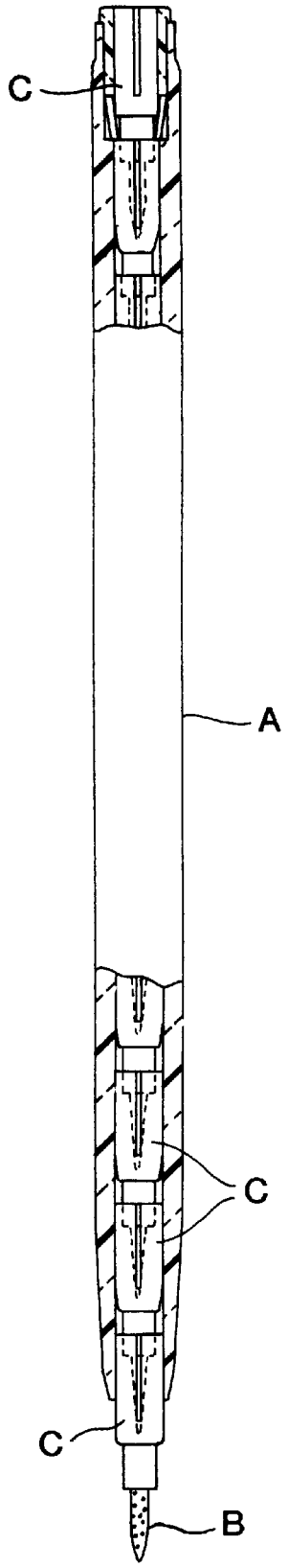
FIG. 10 is a partially sectional view of an example of a prior art non-sharpening pencil.
Figure 11:
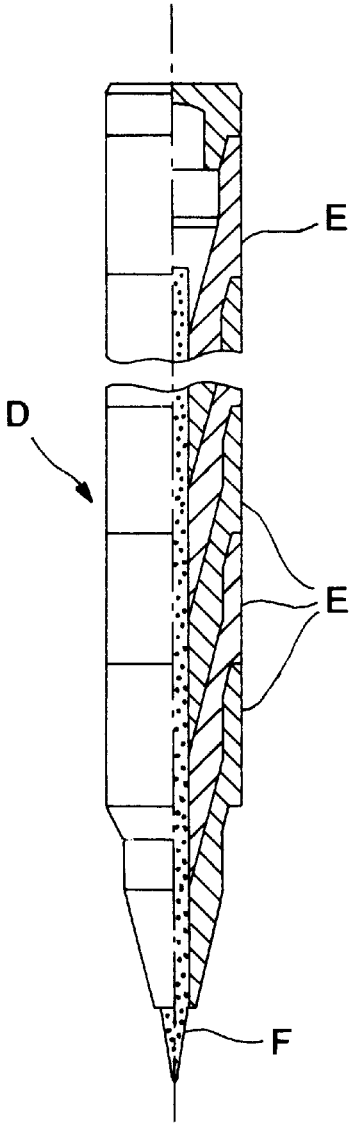
FIG. 11 is a partially sectional view of another example of a prior art non-sharpening pencil.

With reference to FIGS. 8–9, there is shown a second embodiment of the building blocks type writing instrument of the invention, wherein the writing instrument A comprises a plurality of writing units 1*a* and a coupling unit 2*a* located in the center of the instrument. With construction as the above mentioned writing unit 1 basically, the writing unit 1*a* consists of socket block 10, pencil lead 11, tubular projection 12, receiving holes 13, 15 and engaging projection 16 and coupling groove 17. The section of both the socket block 10 and tubular projection 12 are however square in shape. As for the coupling unit 2*a* it is formed in a totally different rectangular box 28 with attached lid 27. At the two ends of the box 28 symmetrically there are two tubular projections 22 equivalent to the above mentioned tubular projection 12 for engaging the writing units 1*a*, and further more the box 28 can be used for storing eraser, paper clips, etc. To protect the attached lid 27 from falling off easily, at the edge of the lid 27 it is installed with a projection 29 for increasing friction force. It is also acceptable if the projection 29 is installed onto the inner edge of the box 28 or onto both of the lid 27 and the box 28. According to another embodiment although it is not showed on the illustration, it will be apparent that both the lid 27 and box 28 can be formed into a single body by means of a thin hinge. Additionally, it is also possible if the tubular projections 22 for the coupling unit 2*a* are attached one on each side of the box 28, or one tubular projection 22 is on one end of the two and two on the other end. Numeral 30 in the figures is a protective cap for pencil lead 11, although the presence or not of one such a cap is not critical but it's better to have one.

Constructed as such of a writing instrument A, it is formed into a flat writing instrument with two double-row sharp ends so the instrument can be held to write as a regular writing instrument and can also be used to draw parallel lines as needed. Under the detached condition, the units are same as the first embodiment and can be used for making up all kinds of creative building blocks as well.

Although preferred embodiments have been disclosed, other embodiments and modifications of the invention are intended to be covered within the spirit and the scope of the appended claims.

What is claimed is:

1. A building block type writing instrument, comprising:

a plurality of tubular writing units, each writing unit having a front end and a rear end, a writing implement disposed at the front end, and a receiving hole in the rear end;

at least one coupling unit having an axial direction and being engaged in the axial direction with at least one of the writing units;

each writing unit including a tubular projection at its front end in which the writing implement is disposed and a receiving hole at its rear end adapted to be coupled with a tubular projection of another writing unit, each writing unit further including on its outer circumferential surface at least one engaging projection and at least one matching coupling groove adapted to receive an engaging projection of another writing unit and extending in an axial direction of the writing unit;

the at least one coupling unit including a block having a block front end and a block rear end, at least one of the block front end and the block rear end having a block tubular projection adapted to be received in the receiving hole on the rear end of one of the writing units, and a block side between the block front end and the block rear end having at least one block tubular projection adapted to be received in the receiving hole on the rear end of one of the writing units extending therefrom.

2. A building block type writing instrument as recited in claim 1, wherein the block of the at least one coupling unit has the block tubular projection on the block front end, the at least one coupling unit further including at least one of a block engaging projection adapted to mate with a coupling groove on a writing unit and a block coupling groove adapted to mate with an engaging projection on a writing unit.

3. A building block type writing instrument as recited in claim 2, wherein the at least one coupling unit includes at least three block tubular projections, a first block tubular projection extending from its front end and and a second and a third block tubular projection extending from one or more sides of the block in opposite directions.

4. A building block type writing instrument as recited in claim 3, wherein the rear end of the at least one coupling unit includes a tubular projection.

5. A building block type writing instrument as recited in claim 2, wherein the rear end of the at least one coupling unit includes a block tubular projection.

6. A building block type writing instrument as recited in claim 2, wherein the rear end of the at least one coupling unit includes a block receiving hole adapted to receive a block tubular projection of another coupling unit or a tubular projection of a writing unit.

7. A building block type writing instrument as recited in claim 1, wherein the at least one coupling unit defines a container having a lid closing an opening of the at least one coupling unit.

8. A building block type writing instrument as recited in claim 7, wherein the lid frictionally engages with the opening.

9. A building block type writing instrument as recited in claim 7, wherein the lid is hingedly connected to edges of the opening.

10. A building block type writing instrument as recited in claim 1, wherein each writing unit is triangular in cross section.

11. A building block type writing instrument as recited in claim 1, wherein each writing unit is rectangular in cross section.

12. A building block type writing instrument as recited in claim 1, wherein each writing unit is square in cross section.

13. A building block type writing instrument as recited in claim 1, wherein each writing unit is polygonal in cross section.

14. A building block type writing instrument as recited in claim 1, wherein each writing unit is circular in cross section.

15. A building block type writing instrument as recited in claim 1, wherein each writing unit is oval in cross section.

* * * * *